US005937785A

United States Patent [19]

Murray, III

[11] Patent Number: 5,937,785

[45] Date of Patent: Aug. 17, 1999

[54] WATER JET POWERED KAYAK WITH REMOVABLE POWER SUPPLY

[75] Inventor: John P. Murray, III, New York, N.Y.

[73] Assignee: J.P. Murray Company, Inc., New York, N.Y.

[21] Appl. No.: 08/861,845

[22] Filed: May 22, 1997

[51] Int. Cl.[6] ..... B63B 35/72

[52] U.S. Cl. ..... 114/347; 440/38

[58] Field of Search ..... 440/3, 4, 6, 88, 440/89, 38; 114/343, 347, 352

[56] References Cited

U.S. PATENT DOCUMENTS

| | | | |
|---|---|---|---|
| 3,043,260 | 7/1962 | Tank | 440/88 |
| 3,408,976 | 11/1968 | Ellis | 440/6 |
| 4,047,494 | 9/1977 | Scott | 115/12 R |
| 4,229,850 | 10/1980 | Arcouette | 9/1.4 |
| 4,497,631 | 2/1985 | Belanger | 440/6 |
| 4,589,365 | 5/1986 | Masters | 114/352 |
| 4,765,075 | 8/1988 | Nakase et al. | 440/38 |
| 4,781,141 | 11/1988 | Webb et al. | 114/288 |
| 4,942,838 | 7/1990 | Boyer et al. | 114/345 |
| 5,209,683 | 5/1993 | Imaeda et al. | 440/38 |
| 5,481,997 | 1/1996 | Arndt | 114/347 |

FOREIGN PATENT DOCUMENTS

| | | | |
|---|---|---|---|
| 406191469 | 7/1994 | Japan | 440/38 |

*Primary Examiner*—Ed Swinehart

*Attorney, Agent, or Firm*—Hedman, Gibson & Costigan, P.C.

[57] ABSTRACT

An improved waterjet propelled kayak having a removable power supply enabling the kayak and separate power supply to be easily transported over land by a single user.

12 Claims, 5 Drawing Sheets

WATER JET POWERED KAYAK WITH REMOVABLE POWER SUPPLY

BACKGROUND AND SUMMARY OF THE INVENTION

The present invention relates in general to small boats propelled by the expulsion of water from a nozzle and particular to kayaks and kayak-like boats using such means of propulsion. The invention relates to an improvement over the type of water craft illustrated and described in U.S. Pat. No. 5,481,997, the disclosure of which is hereby incorporated by reference herein.

The subject invention will enable the watercraft illustrated in U.S. Pat. No. 5,481,997 to realize its full potential by overcoming any practical difficulties associated with the watercraft.

The chief obstacle hampering the success of the watercraft illustrated in U.S. Pat. No. 5,481,997 is that the weight of the watercraft precludes it from being transported in the normal manner of kayaks. Specifically, traditional kayaks are lightweight and easily transported on the roof of a car, eliminating the need for a trailer. Additionally, and more importantly, traditional kayaks must be lightweight to be carried over dry land to and from the body of water where the kayak is to be used. The kayak illustrated in U.S. Pat. No. 5,481,997 is not capable of being transported over land by one person, either to launch the kayak or to carry the kayak back upstream along the bank. Indeed, the weight of the kayak described in U.S. Pat. No. 5,481,997 is extremely difficult to even remove from still water while standing on a level bank, let alone being removed from rushing water along a rocky or uneven bank as is often required with kayak use.

Accordingly, the present invention solves the problems not overcome by the kayak described in U.S. Pat. No. 5,481,997 by providing a modified lightweight kayak of traditional design with a removable power supply. The removability of the power supply enables the kayak to be easily transported over land by a single user and transportable on the roof of a car.

It is a primary object of the present invention to provide a lightweight and easily transportable powered water craft, with a removable power source. This and other objects of the invention will become clear from an inspection of the detailed description of the invention and from the appended Claims.

DETAILED DESCRIPTION OF THE DRAWINGS

Figure 1:
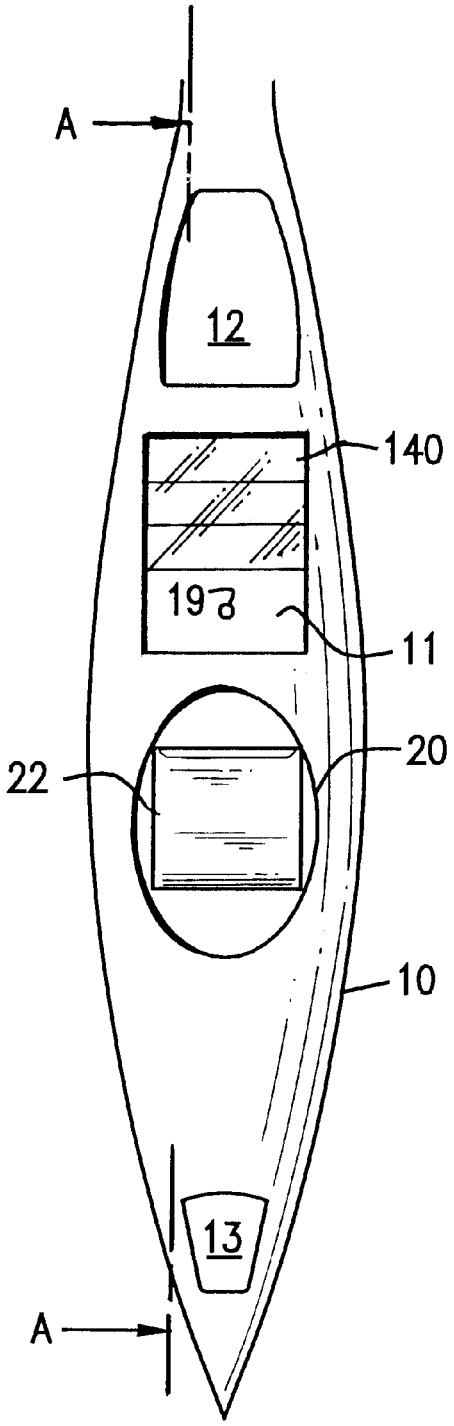
FIG. 1 is a top plan view of a water jet propelled kayak according to this invention.
Figure 1A:
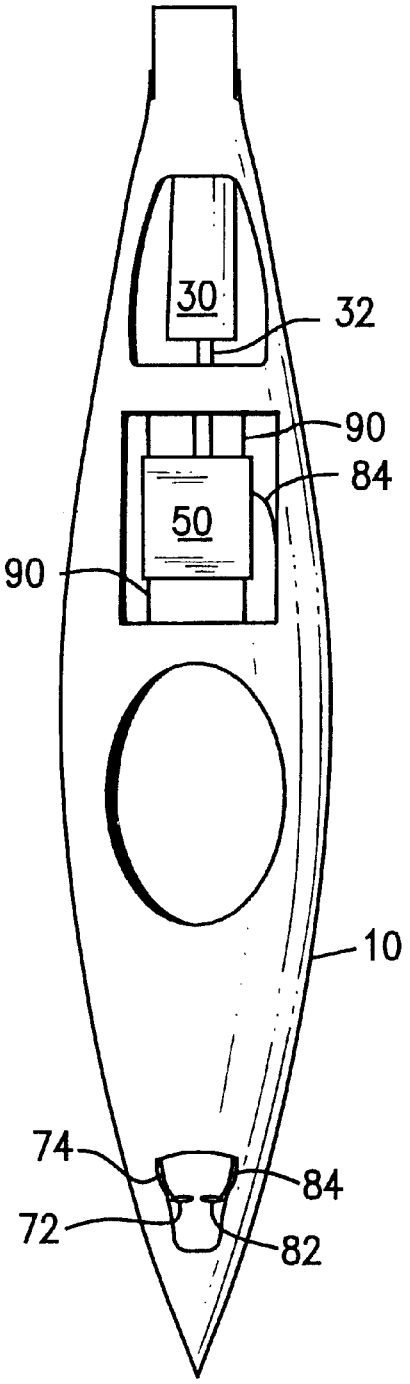
FIG. 1A is a plan view of the kayak of FIG. 1 with the hatches removed.
Figure 2:
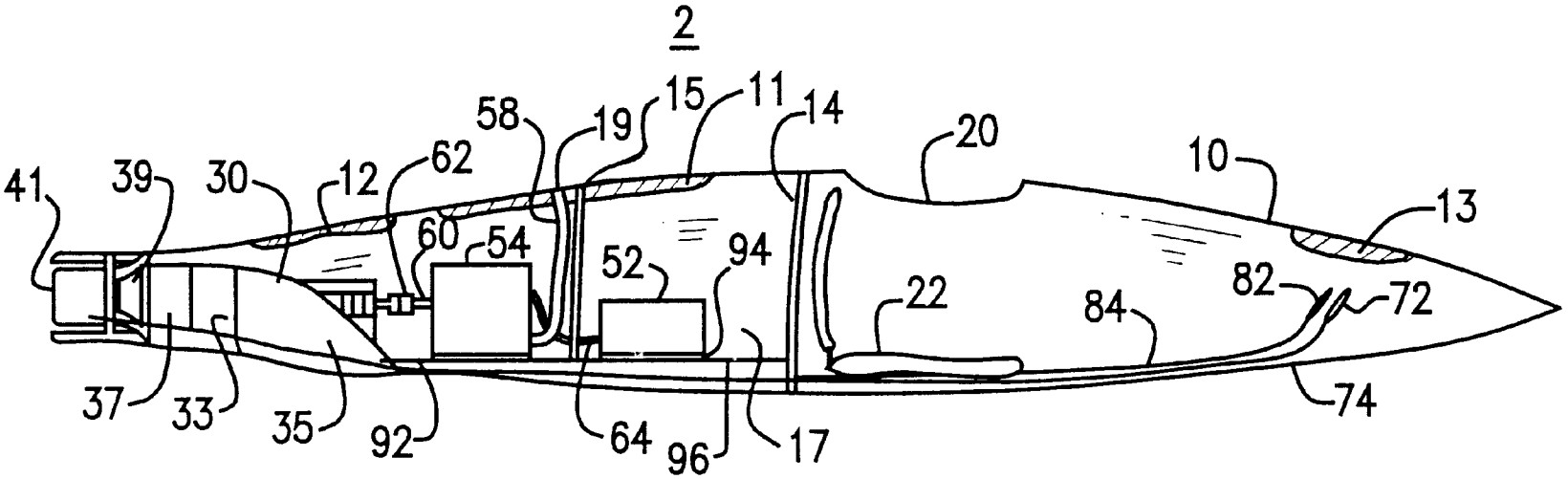
FIG. 2 is a side sectional elevational view taken along lines A—A of the kayak of FIG. 1.

Referring to FIGS. 1, 1A and 2 the kayak 2 of the present invention comprises a hull 10, such as a displacement hull found in kayaks of traditional design, a cockpit 20, a water jet propulsion means 30, a power source 50, steering means 41, a throttle means 82 and a power source mounting means 90.

Hull 10 further comprises engine/fuel access hatch 11, water jet propulsion means access hatch 12, pedal access hatch 13, and bulkheads 14 and 15. Hatch 11 further comprises exhaust vent 19. Cockpit 20 further comprises seat 22.

Figures 3, 3A:
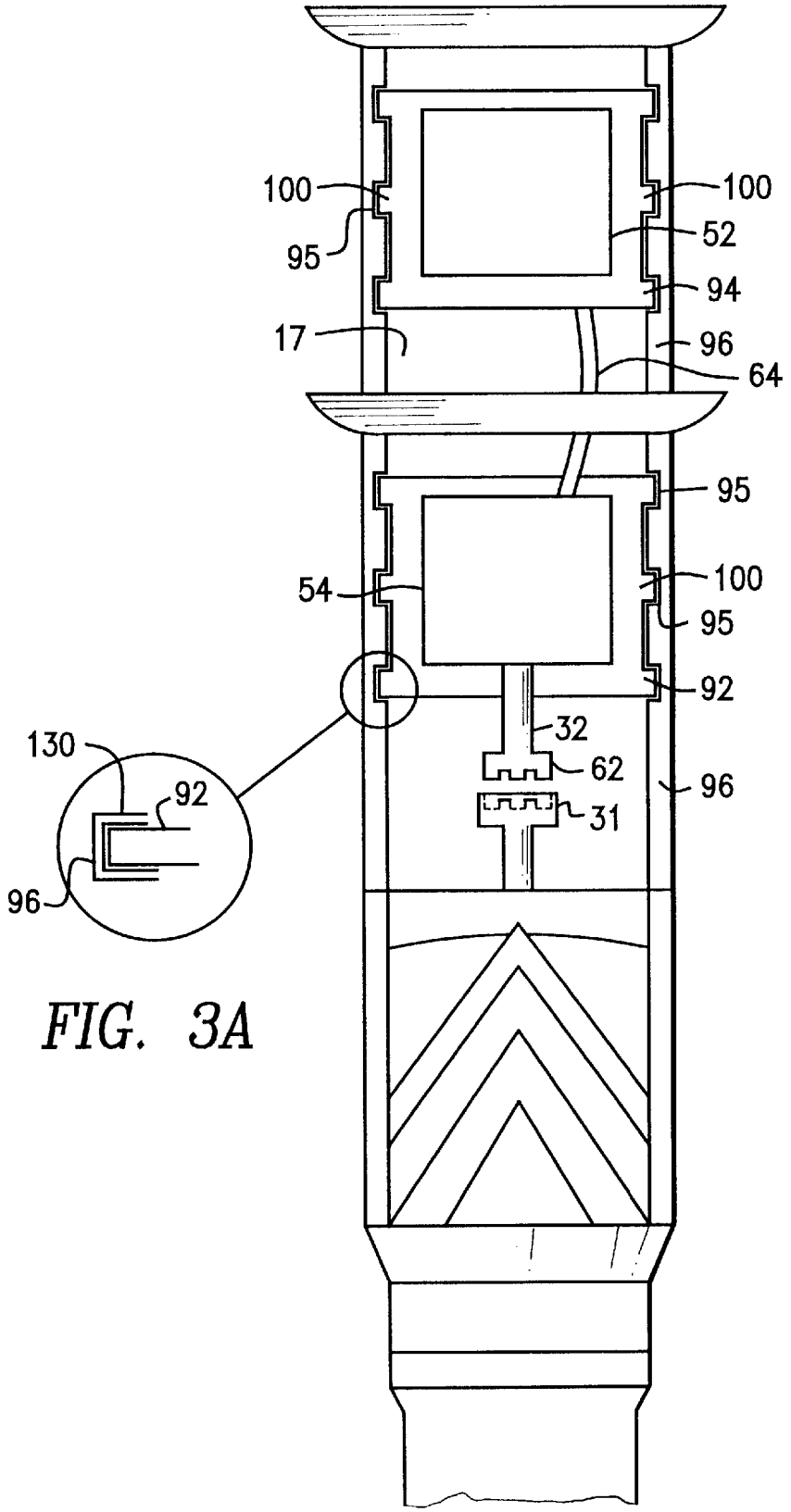
FIG. 3 is a top plan view of a preferred embodiment of the removable power source and means for retaining the removable power source and the engagement means for the power source and drive means.
FIG. 3A is a front view of the load dispersing rails of the present invention detailing the slidable engagement of the engine base and rail.
Figure 4:
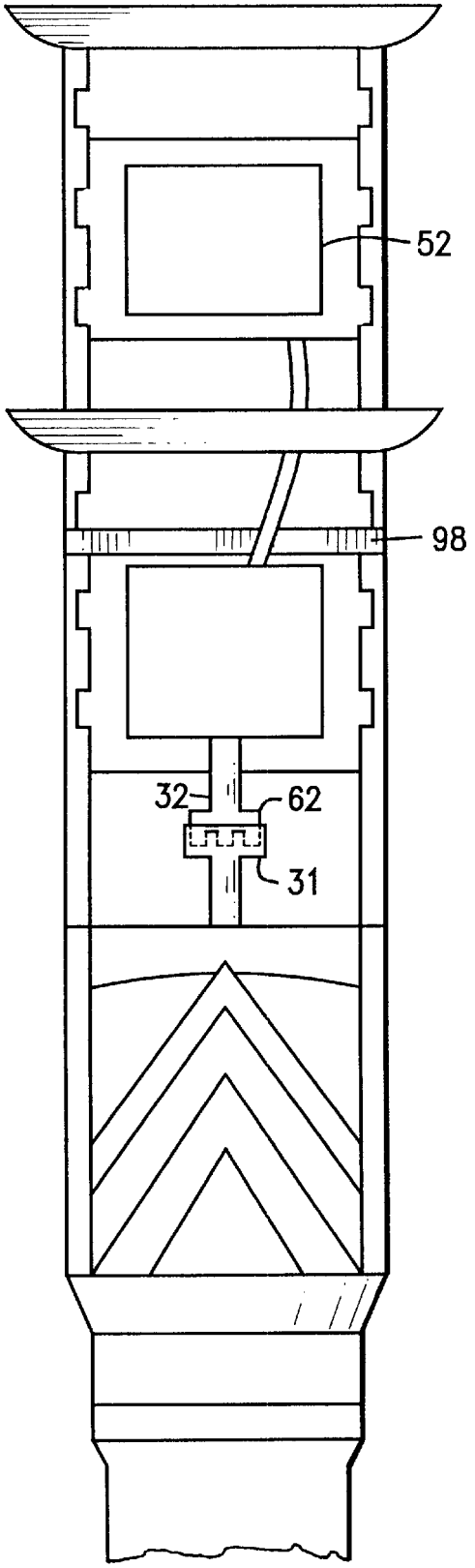
FIG. 4 is the plan view of FIG. 3 detailing the engaged position of the removable power source and drive means.

As best seen in FIGS. 2, 3 and 4 water jet propulsion means 30 further comprises a drive shaft coupling 31, a drive shaft 32, an impeller (not shown), an impeller housing 33, a water intake duct 35, an impeller duct 37, a funneling jet nozzle 39, and stern steering nozzle 41 of known design such as that described in U.S. Pat. No. 4,047,494, incorporated herein by reference.

As best seen in FIGS. 1A and 2, power source 50 further comprises a fuel source 52 such as but limited to, to a fuel tank or battery, an engine or motor 54 such as but no limited to a Honda four stroke engine or an engine of any number of cycles or an electric-motor, an ignition means (not shown), an exhaust means 58, a drive shaft 60, a drive shaft coupling 62 with or without a torque converter, and a connector means 64 for connecting the fuel source to the motor or engine, such as a fuel line where the engine is a combustion engine or an electrical cable wherein the motor is electric. Motor or engine 54 may be water-cooled. Now referring to FIG. 1, in a preferred embodiment the fuel source is a battery and solar panels 140 are disposed on or above the hull of the kayak and the battery is connected to the solar panels to collect and store energy.

Pedal 72 and cable 74 are attached to steering nozzle 41 to enable an operator to steer the watercraft.

Throttle means 82 comprises pedal 82 and cable 84. Throttle means 82 can also be a stick-type throttle commonly found in pleasure craft.

Now referring to FIG. 3, 3A and 4 in a preferred embodiment power source mounting system 90 further comprises engine base 92, fuel source base 94, load dispersing rails 96 and overcenter clamp 98. Engine base 92 further comprises at least two opposing flanges 100. Fuel source base 94 also further comprises at least 2 opposing flanges. Load dispersing rails 96 further comprise at least two opposing notches 95 for receiving the flanges 100. Rails 96 have a slotted flange design as best seen FIG. 3A, including a top portion 130. Overcenter clamp 98 or any securing means such as, but not limited to, pins, screw-type engagement means, bolting means, spring clips, etc. secures engine base 92 and fuel source base 94 in rails 96.

A flexibility closure for keeping the cockpit watertight is not shown. Furthermore, it is contemplated that cockpit 20 may be modified to accommodate more than one person.

Referring to FIGS. 1 and 2, in a preferred embodiment bulkhead 14 is immediately aft of cockpit 20. Aft of bulkhead 14 is fuel source compartment 17 formed by bulkheads 14 and 15 and engine/fuel access hatch 11. Load dispersing rails 96 may be located within fuel source compartment 17. Fuel source 52 may be removably and slidably engaged on load dispersing rails 96 by means of fuel source base 94. Aft of bulkhead 15 is a motor or engine mounting area, wherein further load dispersing rails are located for slidably and removably receiving engine base 92 which is attached to engine or motor 54.

Now referring to FIGS. 1, 3 and 4 the fuel source 52 is engaged with load dispersing rails 96 by an operator by opening engine/fuel access hatch 11, lowering the fuel source 52 into the fuel source compartment 17 so that the at least 2 opposing flanges 100 of the base 94 are aligned with the corresponding notches 95 for receiving said flanges. The entire fuel source 52 is then slid along and within said rails until the base 94 is stopped by a grommet or other cushioning means (not shown). The fuel source 52 can be locked in place by any known releasable rail locking means such as overcenter clamp 98. In a preferred embodiment overcenter clamp 98 is spring loaded and secures base 94 to rails 96. Fuel source 52 may alternatively be secured by means such as bungee cords, brackets, etc., eliminating the need for fuel source base 94 and load dispersing rails 96 for the fuel source.

Engine or motor 54 is engaged in the same manner as the fuel source. Fuel source 52 is then connected to engine 54 with connector means 64. In addition, when engine 54 is slidably engaged into the locked position, as shown in FIG. 4, drive shaft couplings 62 and 31 engage to join the jet propulsion system to the power source.

Now referring to FIGS. 2, 3 and 4, engine 54 turns drive shaft 32 through couplings 62 and 31 which in turn transfers rotational power to the impeller in impeller housing 33. The couplings can be direct drive or can incorporate a torque converter. The impeller receives water via water intake duct 35 and accelerates the water and communicates it through an impeller duct 37 to funneling jet nozzle 39. Water is further accelerated as it is funneled by the jet nozzle 39 to the stern nozzle 41 which is a steering nozzle of known construction.

Now referring to FIGS. 1A and 2, throttle cable 84 links pedal 82 to engine 54. Steering cable 74 links pedal 72 to nozzle 41. In another embodiment, steering cable 74 is attached to two small rudders (not shown) mounted longitudinally on opposite sides of a non-steerable stern nozzle 41.

Now referring to FIGS. 1 and 2, the hatches 12 and 13 are water tight and afford easy maintenance access to water jet propulsion means 30 and pedals 72 and 82. Hatch 11 is water tight and further comprises exhaust vent 19. The orientation of the vent prevents water from entering the vents should the kayak roll.

In a preferred embodiment, the weight of the propulsion means 30 and power source 50 is distributed in such a manner that when the kayak of the present invention rolls, the kayak is self righting.

While the invention has been described in connection with what is presently considered to be the most practical and preferred embodiments, it is understood that the invention is not to be limited to the disclosed embodiment, but on the contrary, is intended to cover various modifications and equivalent arrangements included within the spirit and scope of the appended claims.

I claim:

1. A kayak comprising a. a kayak hull having a cockpit, said cockpit further comprising an opening formed in said hull for a kayak operator;

b. at least one compartment located behind said cockpit defined by at least one bulkhead, said hull and at least one hatch for receiving a removable power source;

c. a means for accelerating water sternward disposed within said hull;

d. a means for connecting said power source to said means for accelerating water sternward;

e. intake means communicating with a body of water on which the kayak is located for providing water to the means for accelerating water;

f. a means for steering said kayak;

g. a throttle means operatively connected to said power source and controllable by an operator of said kayak; and h. a means located in said compartment for removably mounting said power source, said power source further comprising a fuel source and a motor.

2. The kayak of claim 1 wherein the fuel source is a tank for containing combustible fuel and the motor is an internal combustion engine.

3. The kayak of claim 1 wherein the motor is an electric motor.

4. The kayak of claim 3 wherein said hull further comprises at least one solar panel for collecting solar energy and said battery is operatively connected to said solar panel.

5. The watercraft of claim 1 comprising a watertight hatch for accessing said means for accelerating water sternward and a watertight hatch for accessing said steering and throttle means.

6. The watercraft of claim 1 wherein the means for accelerating water sternward is a water jet propulsion unit.

7. The watercraft of claim 1 wherein said fuel source is received and contained in a first compartment directly aft of said cockpit and said motor is received and contained in a second compartment aft of said first compartment.

8. A watercraft comprising a. kayak hull having a cockpit;

b. at least one compartment defined by at least one bulkhead and said hull and at least one hatch disposed on said hull for receiving a removable power source;

c. a means for accelerating water sternward disposed within said hull;

d. a means for connecting said power source to said means for accelerating water sternward;

e. intake means communicating with a body of water on which the watercraft is located for providing water to the means for accelerating water;

f. a means for steering said watercraft;

g. a throttle means operatively connected to said power source and controllable by an operator of said watercraft; and h. a means located in said compartment for removably mounting said power source and wherein said removable mounting means is a pair of parallel rails each having a top and a side, said rails aligned along a longitudinal axis of said watercraft and disposed on the floor of said hull, each of said rails further comprising a slotted opening formed along at least one side of each rail, said slots of said rails facing each other, said rails each further having at least one notched opening formed within its top.

9. The watercraft of claim 3 wherein said power source comprises a base plate which slidably and removably engages said pair of parallel rails.

10. The watercraft of claim 4 wherein said rails further comprise at least one power source retaining means.

11. The watercraft of claim 5 wherein said power source retaining means is an overcenter clamp.

12. The kayak of claim 6 wherein said fuel source is received and contained in a first compartment directly aft of said cockpit and said motor is received and contained in a second compartment aft of said first compartment.

* * * * *